United States Patent [19]

Riley

[11] Patent Number: 4,550,966

[45] Date of Patent: Nov. 5, 1985

[54] ELECTRICAL CABLE CONNECTORS

[75] Inventor: Roy C. Riley, North Tazewell, Va.

[73] Assignee: J & R Manufacturing, Inc.

[21] Appl. No.: 573,371

[22] Filed: Jan. 24, 1984

[51] Int. Cl.[4] ..... H01R 13/639

[52] U.S. Cl. ..... 339/84; 339/87; 339/89 R

[58] Field of Search ..... 339/89 R, 89 L, 89 M 82, 339/83, 84, 87, 37

[56] References Cited

U.S. PATENT DOCUMENTS

| | | | |
|---|---|---|---|
| 3,311,865 | 3/1967 | Devito | 339/132 R |
| 3,755,772 | 8/1973 | Reed | 339/37 |
| 4,033,662 | 7/1977 | Swiger | 339/184 R |

FOREIGN PATENT DOCUMENTS

| | | | |
|---|---|---|---|
| 458966 | 4/1928 | Fed. Rep. of Germany | 339/89 R |
| 1183991 | 7/1959 | France | 339/89 M |
| 168868 | 4/1934 | Switzerland | 339/82 |

*Primary Examiner*—John McQuade

*Attorney, Agent, or Firm*—Larson and Taylor

[57] ABSTRACT

The invention is directed to improvements in electrical cable connectors for safe use with electric motor driven mine equipment in coal mines in which gassy conditions normally create great danger of explosion caused by incendive arcing or sparking. In accordance with the invention the receptacle and plug components of the connector, after being screwed together are locked in operative position by the provision of a padlock the stem of which passed through a hole in a locking ear of a mounting flange on the receptacle component, is engaged as one of a series of undulations in the surface of a compression lock ring on the plug component facing the locking ear. Unlike all prior constructions in which the mounting flange is permanently integral with the receptacle component, the mounting flange according to this invention is temporarily but securely fixed in place during operations but is removable if the locking ear becomes broken (a not uncommon occurrence) and may be simply replaced without replacing the whole expensive receptacle component.

2 Claims, 5 Drawing Figures

ELECTRICAL CABLE CONNECTORS

BACKGROUND OF THE INVENTION

This invention relates to an electrical cable connector for use with electric motor driven mine equipment in coal mines in which because of the gassy conditions which exist there is great danger of explosion cause by an electrical spark.

DESCRIPTION OF THE PRIOR ART AND PROBLEM STEMMING THEREFROM

Electrical connectors of the type to which this invention relates are disclosed in a number of United States patents, one of which U.S. Pat. No. 4,033,662 to James W. Swiger to which reference will be made herein to illustrate the novel improvement thereover which the present invention provides.

So dangerous is the possibility of explosions in gassy coal mines that the Bureau of Mines, of the United States Department of the Interior has promulgated very stringent regulations and requirements governing the kinds electrical connectors which may be used. Reference is here made to Schedule 2G issued by the Bureau of Mines, approved Mar. 19, 1968. In that Schedule 2G, §18.41 concerns the requirements for plug and receptacle type connectors of the type to which this invention relates. It states:

"(a) Plug and receptacle-type connectors for use in by the last open crosscut in a gassy mine shall be so designed that insertion or withdrawal of a plug cannot cause incendive arcing or sparking. Also, connectors shall be so disigned that no live terminals, except as hereinafter provided, are exposed upon withdrawal of the plug."

And it then lists the requirements which if complied with, will render such connectors acceptable.

The United States Patent to Swiger, U.S. Pat. No. 4,033,662 discloses an acceptable type, and its commercial embodiment has proved satisfactory in actual use under the very dangerous gassy mine conditions to which reference has been made.

The Swiger plug and rectacle connector and others of the same type are provided with an integral mounting flange having a locking ear. The importance of the arrangement is emphasized by the fact that it is the subject of one of the requirements of §18.41 of Schedule 2G of the Bureau of Mines, which states:

"(f) For a mobile battery-powered machine, a plug padlocked to the receptacle will be acceptable in lieu of an interlock provided that the plug is held in place by a threaded ring or equivalent mechanical fastening in addition to the padlock. A connector within a padlocked enclosure will be acceptable."

Commercial embodiments of the electrical cable connectors of the type shown in the Swiger U.S. Pat. No. 4,033,662 when in use, however, are subject to a rather common disadvantage in that the locking ear on the mounting flange becomes broken. It is a well known fact that one of the biggest reasons the coal companies are cited for violations by the Federal Inspectors, (MSHA) is because of the breaking of the locking ear on the mounting flange.

For many years and up to the advent of the present invention, the only remedy for the problem of breakage of a locking lug has been the complete replacement of entire receptacle which is not only time consuming and of some difficulty, but is a matter of considerable expense.

It is a principal object of this invention to overcome these disadvantages by providing an arrangement which substantially eliminates the time consuming difficulties and the great expense of replacing the entire receptacle simply because of the breakage of a locking ear.

SUMMARY OF THE INVENTION

The invention comprises a special mounting flange for a receptacle of an electrical receptacle and plug connector of the type the use of which is permitted in gassy coal mines. The mounting flange instead of being rigidly integral with the body of the receptacle in a manner not permitting its removal, is securely but easily mounted on the body of the receptacle. This is accomplished by the use of a series of set screws positioned in aligned bores in the flange and in the body of the receptacle. The mounting flange is provided with a locking ear. Breakage of the locking ear, a not uncommon occurance in prior art structures, can be remedied by removing and replacing the mounting flange without the necessity of replacing the entire expensive receptacle.

DESCRIPTION OF THE PREFERRED EMBODIMENT

Figure 1:
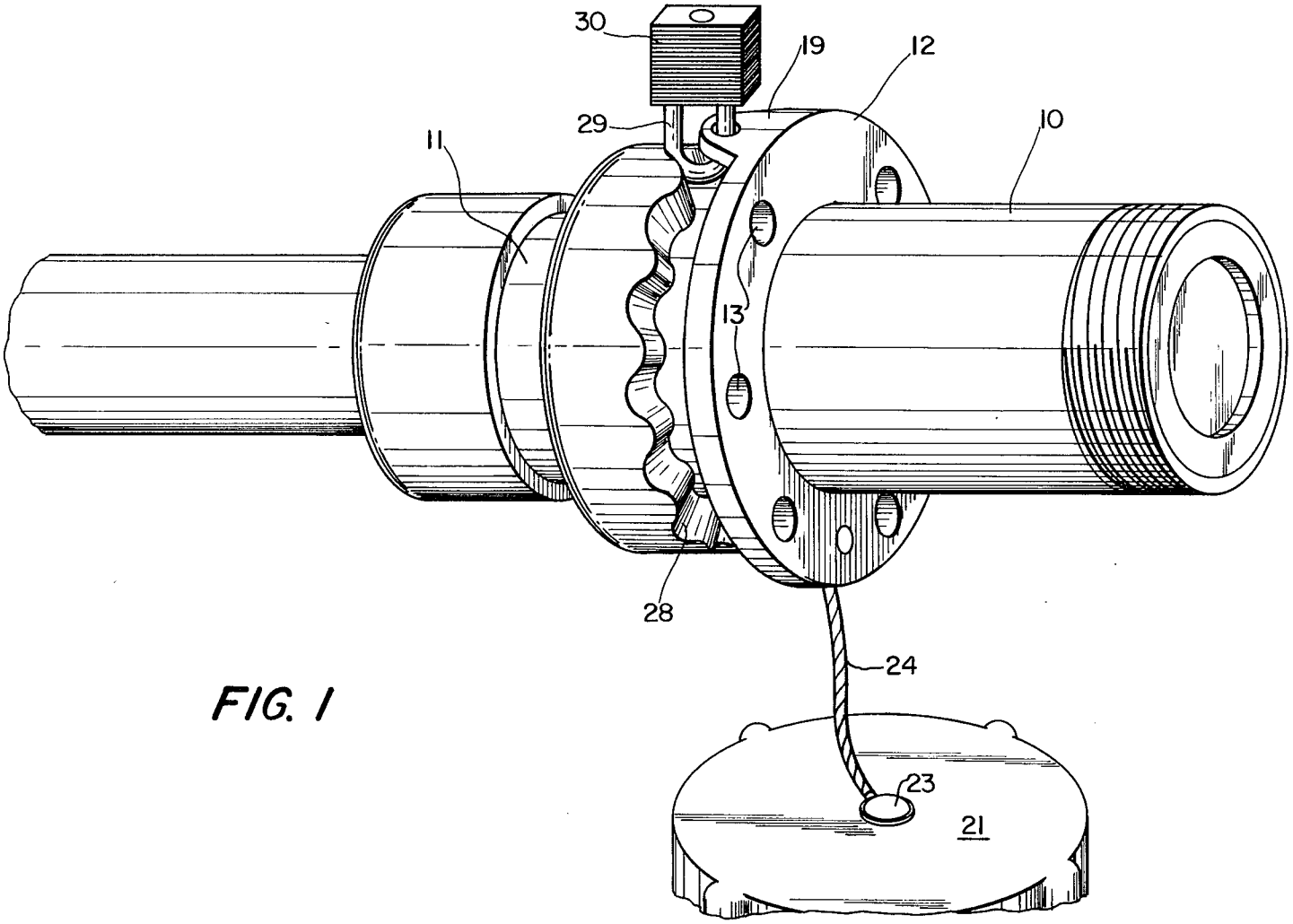
FIG. 1 is a perspective view of an electrical receptacle and plug connector provided with a mounting and locking flange according to the invention.

With reference to the drawings the electrical connector is comprised of a receptacle components 10 which when in use is structured to receive a plug component 11. The casing of the receptacle 10, in practice, is constructed of machinable brass and is open at one end to receive the plug component 11 as shown in FIG. 2.

The particular structure and arrangement of the elements which comprise the plug component 11, and the elements disposed within the casing of the receptacle 10 are of no importance to an understanding of the invention. A substantially similar construction of such elements is illustrated and described in the Swiger U.S. Pat. No. 4,033,662 to which reference may be made if desired.

In accordance with the present invention, the casing of the receptacle component 10 has mounted thereon an annular mounting flange 12 having a series of bores 13 therein which extend parallel to the axis of the receptacle casing and which are equally spaced around the flange 12.

Figure 2:
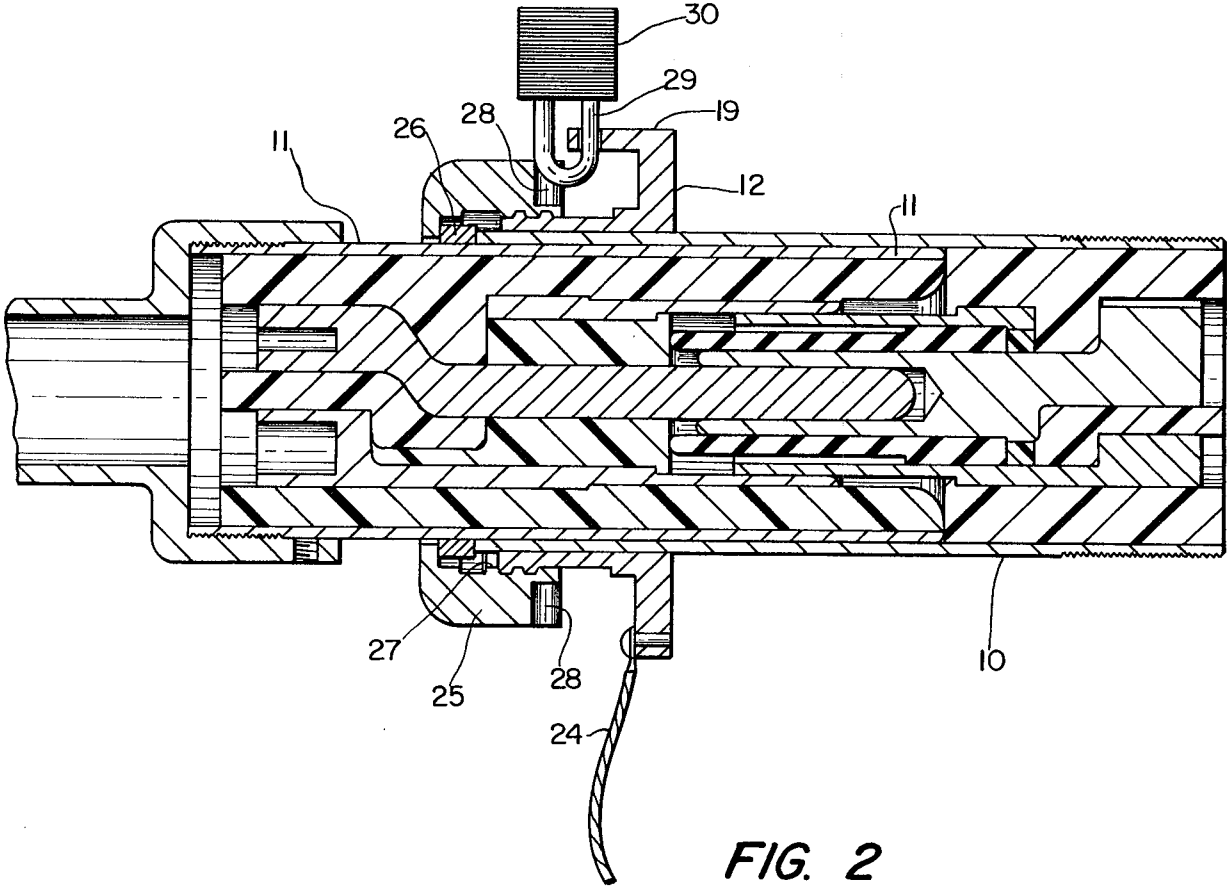
FIG. 2 is partial vertical section of the connector of FIG. 1.
Figure 3:
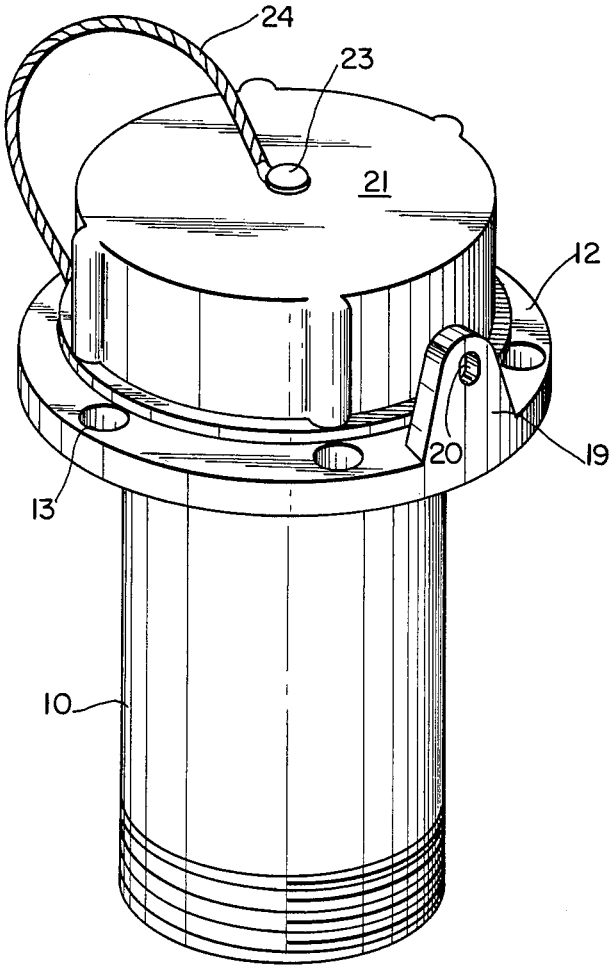
FIG. 3 is a perspective view of the receptacle component of the connector with the cap in place as when the connector is not in use.
Figure 4:
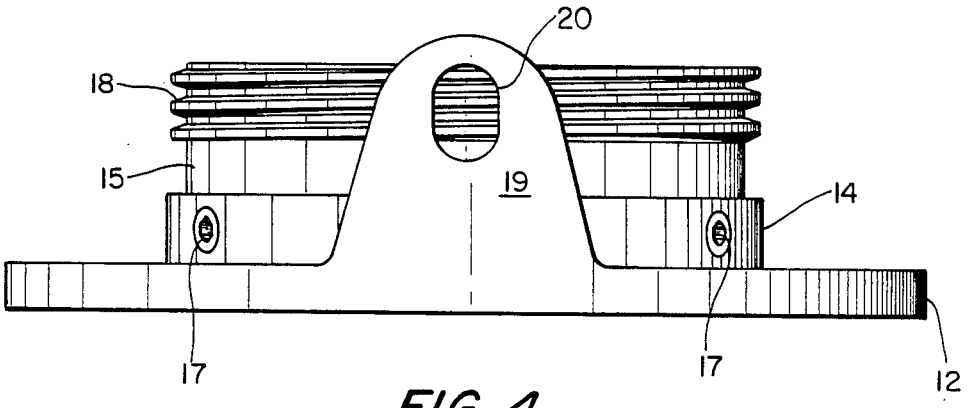
FIG. 4 is a side elevation of the mounting and locking flange according to the invention.
Figure 5:
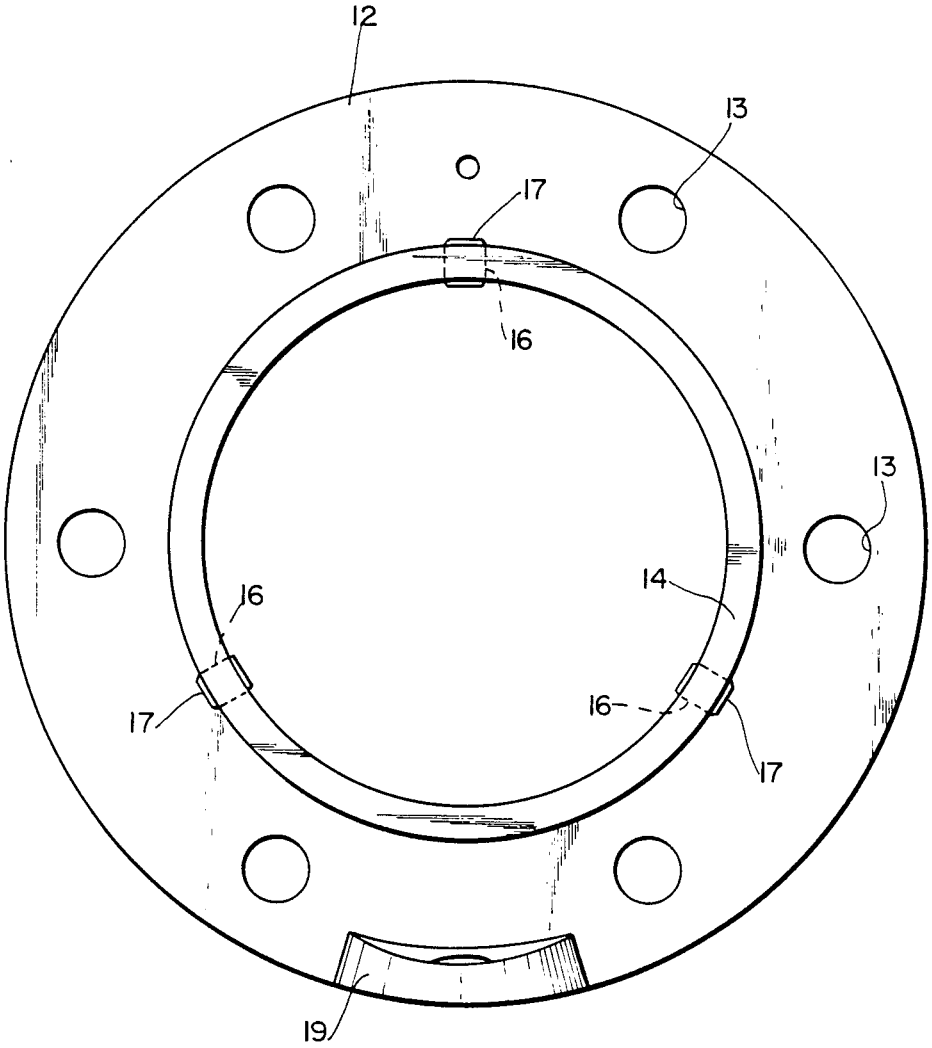
FIG. 5 is an end elevation of the mounting and locking flange according to the invention.

With reference, particularly to FIGS. 4 and 5, it will be noted that the flange 12 is provided with a sleeve 14 which has an inner diameter just sufficiently large as to permit it to be forced over the casing of the receptacle 10 to the position shown in FIGS. 1–3.

The sleeve 14 is provided with three or more radially directed threaded bores 16 adapted to receive an equal number of set screws 17. These are employed to lock the flange 12 securely in place when the connector is in operation, but, which when unscrewed permit the flange 12 to be removed from the casing of the receptacle 10 when it becomes necessary as will be explained.

The sleeve 14 has a portion 15 which extends in an axial direction towards the open end of the receptacle component 10 and terminates in a threaded portion 18.

Also as clearly illustrated in FIGS. 4 and 5 the mounting flange is provided at its periphery with an upstanding locking ear 19. The ear 19 is disposed to be parallel to the axis of the receptacle casing and is spaced radially outward from the sleeve 14. It is provided with a hole 20 adapted to receive a padlock which has been indicated by government regulations to provide satisfactory locking as will be described.

When the connector is not in use and the receptacle and plug components are separated, the open end of the receptacle 10 is covered by a cap 21 having inner threads (not shown) which permit the cap to be screwed on to the threaded portion 18 of the sleeve 14 of the mounting flange 12. Such cap arrangements are common in the art a similar arrangement being shown, for example, in FIG. 1 of the Swiger U.S. Pat. No. 4,033,622 referred to earlier.

The cap 21 is provided with a cap pin 23 to which is attached a retainer cable 24, preferably plastic coated, and which is anchored to the mounting flange 12, as shown.

Referring to FIG. 2 the plug component 11 is provided on its outer surface with a compression lock ring 25 provided with jam ring 26 for anchoring the lock ring in place. The compression lock ring 25 is provided with interior locking threads 27 which are adapted to engage the threaded portion 18 on the sleeve 14 of the mounting flange 12, thus locking the receptacle component 10 and plug component 11 together when assembled for use.

As can be appreciated from the Government Safety Requirements, it is of extreme importance that once the plug and receptacle components are screwed together in operative position that means be provided for locking them in such position. In accordance with the present invention such locking is effected by providing the surface of the compression ring 25 which faces the locking ear 19 with a series of undulations 28. These extend annually around the facing and are of a depth just sufficient to permit the leg 29 of a padlock 30 which has been passed through the hole 20 in the locking ear 19 to also be engaged in one of the undulations 28 in the compression ring 25. It should be clear that when in such position the leg 29 of the padlock 30 will positively prevent any accidental unscrewing of the receptacle and plug components.

The mounting flange 12, as in the prior art commercial structures, is constructed of iron which well serves the purpose except that occasionally the locking ear 19 will break if accidentally struck by a piece of machinery or a tool. While this would not appear to be fatal from an operational standpoint, it is most serious from a safety standpoint, and as mentioned above, constitutes a breach of government regulations resulting in a violation citation by Federal Inspectors. While, for years on end, the only cure was to replace the entire receptacle component 10 with its integral mounting flange 12, the present invention now makes it possible to quickly and inexpensively remedy the damage, simply by loosening the set screws 17 on the portion 15 of the sleeve 14 of the mounting flange 12, sliding the mounting flange off of the casing of the receptacle component 10, and then placing thereon a new mounting flange.

Some research of the end-user's time, safety precautions, ease and facility of replacement and considerations, has made it evident that this novel and unique application will be an asset to them in every respect. Where the breakage of the locking ear constitutes an active violation, which up to the present has given rise to the mandatory replacement of the entire receptacle, it is manifest that this present solution will prove of benefit to all concerned. And indeed the solution to the problem was not obvious to those in the art whose only answer to the breakage problem was to go through the time consuming and very expensive process of replacing the entire receptacle components.

This invention is rather specifically directed to the solution of a special problem in a very specialized field where the mechanisms and their uses are rigidly controlled by the government so that all safety precautions may be observed. Accordingly, it is doubted whether many variations may be made. It is trusted that those that may safely be made will fall within the scope and purview of the following claims.

I claim:

1. An electrical cable connector for safe use with electric motor driven mine equipment in coal mines in which gassy conditions normally create great danger of explosion caused by incendive arcing or sparking, comprising, a receptacle component having a cylindrical casing and an open end, a plug component adapted to be partially inserted in the open end of the receptacle component, means for securing and locking said components in joined operative position, said means comprising a compression lock ring securely mounted on the outer exposed surface of said plug component and having locking threads thereon, and a mounting flange mounted on the outer surface of said receptacle component, said mounting flange having a mounting sleeve with a threaded portion adapted to engage the locking threads on said compression lock ring, said mounting flange having a locking ear thereon, said compression lock ring having a means adapted to be engaged by a leg of a padlock passed through the locking ear of the mounting flange whereby the components may be prevented from accidental uncoupling, said sleeve having a series of radial bores therein, a series of set screws adapted to be received in said bores, whereby if the locking ear on the mounting flange becomes damaged, the mounting flange may be replaced without the necessity of replacing the entire receptacle component.

2. An electrical cable connector for safe use with electric motor driven mine equipment in coal mines in which gassy conditions normally create great danger of explosion caused by incendive arcing or sparking, comprising, a receptacle component having a cylindrical casing and an open end, a plug component adapted to be partially inserted in the open end of the receptacle component, means for securing and locking said components in joined operative position, said means comprising a compression lock ring securely mounted on the outer exposed surface of said plug component and having locking threads thereon, and a mounting flange mounted on the outer surface of said receptacle component, said mounting flange having a mounting sleeve with a threaded portion adapted to engage the locking threads on said compression lock ring, a locking ear on said mounting flange and extending in the direction of the open end of said receptacle component, said locking ear having a hole therein to receive a leg of a padlock, said sleeve having a series of radial bores therein, a series of set screws adapted to be received in said bores, whereby if the locking ear on the mounting flange becomes damaged, the mounting flange may be replaced without the necessity of replacing the entire receptacle component, the surface of the compression lock ring facing in the direction of the locking ear having undulations around its circumference, the depth of which is just sufficient to permit a leg of a padlock to be engaged therein when the plug component and the receptacle component are joined in operative positions, whereby a leg of a padlock may be engaged both by the hole in locking ear and in one of the undulations in said compression ring to securely prevent accidental uncoupling of said components.

* * * * *